US007891945B2

(12) United States Patent
Tisenchek et al.

(10) Patent No.: US 7,891,945 B2
(45) Date of Patent: Feb. 22, 2011

(54) METHODS FOR PLUGGING TURBINE WHEEL HOLES

(75) Inventors: Nicholas A. Tisenchek, Clifton Park, NY (US); Frederick G. Baily, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 11/971,986

(22) Filed: Jan. 10, 2008

(65) Prior Publication Data

US 2009/0180871 A1 Jul. 16, 2009

(51) Int. Cl.
*F01D 5/08* (2006.01)

(52) U.S. Cl. ..... 416/97 R; 415/115; 29/889.2

(58) Field of Classification Search ..... 415/115; 416/95, 97 R, 96 R; 29/889.1, 889.2, 889.12
See application file for complete search history.

(56) References Cited

U.S. PATENT DOCUMENTS 1,819,864 A * 8/1931 Bloomberg ..... 415/168.4
2,021,289 A * 11/1935 Caylor ..... 415/188
2,297,853 A * 10/1942 Zetterquist ..... 415/145
4,393,658 A * 7/1983 Bohnenkamp et al. ..... 415/144
4,425,077 A * 1/1984 Martin ..... 415/115
6,227,799 B1 * 5/2001 Kuhn et al. ..... 415/115
6,994,516 B2 * 2/2006 Takahashi et al. ..... 415/115

* cited by examiner

*Primary Examiner*—Igor Kershteyn
(74) *Attorney, Agent, or Firm*—Mark E. Henderson; Ernest G. Cusick; Frank A. Landgraff

(57) ABSTRACT

A method for plugging a turbine wheel hole in a turbine wheel. The method may include the steps of: 1) obtaining a turbine wheel hole plug that includes an approximate cylindrical body, a first flange at a first end of the body, and a hollow cylinder at the second end of the body, wherein the body, the first flange and the hollow cylinder are sized such that: a) the cylindrical body fits snuggly into the turbine wheel hole; b) the first flange comprises a diameter that is greater than the diameter of the turbine wheel hole; and c) the hollow cylinder protrudes from one end of the turbine wheel hole when the turbine wheel hole plug is inserted into the other end of the turbine wheel hole until the first flange abuts the turbine wheel; 2) positioning the turbine wheel hole plug into the turbine wheel hole; and 3) deforming the hollow cylinder so that the hollow cylinder flares outward.

20 Claims, 3 Drawing Sheets

METHODS FOR PLUGGING TURBINE WHEEL HOLES

BACKGROUND OF THE INVENTION

This present application relates generally to systems and apparatus for modifying turbine wheel holes. More specifically, but not by way of limitation, the present application relates to systems and apparatus for enhancing turbine performance by reducing or plugging turbine wheel holes.

Turbine wheel holes are common in the turbine industry. Generally, these holes are defined through turbine wheels, which connect the turbine buckets or blades to the rotor. Turbine wheel holes allow the passage of a secondary flow of working fluid through the turbine wheels. This flow path may be provided for several reasons. First, for example, turbine wheel holes allow the leakage of secondary flow through the turbine wheel so to prevent reentry of the working fluid back into the primary flow path, which may cause inefficient flow patterns. In addition, wheel holes may be used to reduce the pressure drop across a turbine stage or to reduce axial pressure on the turbine wheel, which under certain operating conditions may be preferred or necessary. Generally, turbine wheel holes may measure approximately 0.5 to 3.0 inches in diameter and, when present, a turbine wheel may have approximately 3 to 15 wheel holes defined through its axial thickness.

Often, it becomes desirable to cover, plug, block or partially block turbine wheel holes. Depending on certain operating conditions, it may be preferable to completely block turbine wheel holes so that no flow is allowed to pass therethrough, or it may be preferable to partially block turbine wheel holes, i.e., reducing the diameter of the wheel hole, so that a decreased amount of flow is allowed to pass therethrough. The reasons for blocking or reducing turbine wheel holes may be several. Many times, plugging the turbine wheel holes is done during the process of refurbishing older turbine engines. The plugging is done to improve the efficiency of the engine. However, processes, systems and/or apparatus currently used for plugging turbine wheel holes are overly complex, time consuming and expensive. Thus, there is a need for improved methods, systems and/or apparatus for plugging turbine wheel holes in an efficient and cost effective manner.

BRIEF DESCRIPTION OF THE INVENTION

The present application thus describes a method for plugging a turbine wheel hole in a turbine wheel. The method may include the steps of: 1) obtaining a turbine wheel hole plug that includes an approximate cylindrical body, a first flange at a first end of the body, and a hollow cylinder at the second end of the body, wherein the body, the first flange and the hollow cylinder are sized such that: a) the cylindrical body fits snuggly into the turbine wheel hole; b) the first flange comprises a diameter that is greater than the diameter of the turbine wheel hole; and c) the hollow cylinder protrudes from one end of the turbine wheel hole when the turbine wheel hole plug is inserted into the other end of the turbine wheel hole until the first flange abuts the turbine wheel; 2) positioning the turbine wheel hole plug into the turbine wheel hole; and 3) deforming the hollow cylinder so that the hollow cylinder flares outward.

The present application further describes another method for plugging a turbine wheel hole in a turbine wheel. This method may include the steps of: 1) obtaining a turbine wheel hole plug that includes an approximate cylindrical body, a first flange at a first end of the body, and a hollow cylinder at the second end of the body, wherein the body, the first flange and the hollow cylinder are sized such that: a) the cylindrical body fits snuggly into the turbine wheel hole; b) the first flange comprises a diameter that is greater than the diameter of the turbine wheel hole; and c) the hollow cylinder protrudes from one end of the turbine wheel hole when the turbine wheel hole plug is inserted into the other end of the turbine wheel hole until the first flange abuts the turbine wheel; 2) positioning the turbine wheel hole plug into the turbine wheel hole such that the first flange abuts the turbine wheel; 3) using means for securing the axial position of the first flange so that the first flange is secured against the turbine wheel hole; and 4) pushing a cone into the hollow cylinder so that the hollow cylinder spreads outward.

These and other features of the present application will become apparent upon review of the following detailed description of the preferred embodiments when taken in conjunction with the drawings and the appended claims.

DETAILED DESCRIPTION OF THE INVENTION

Figure 1:
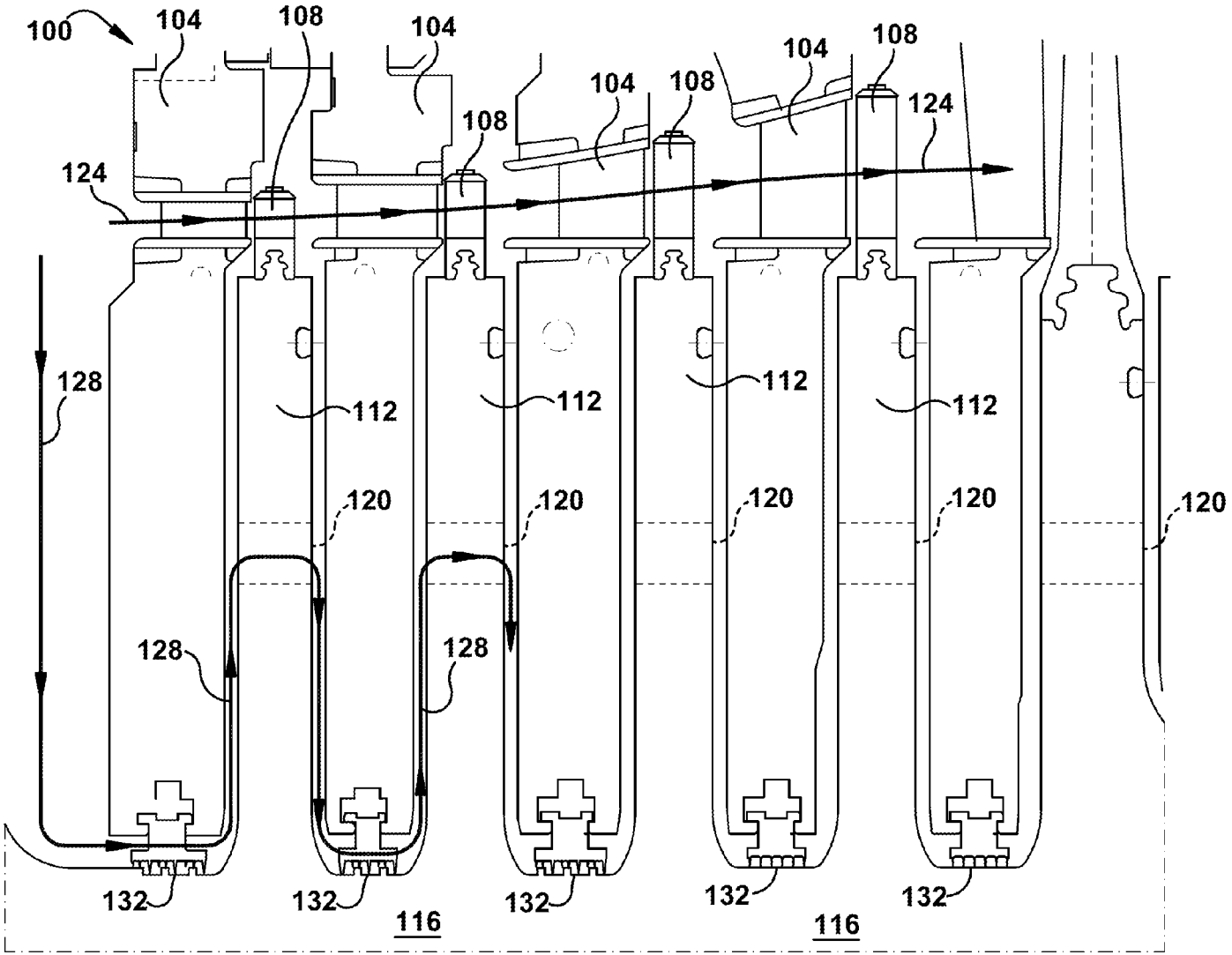
FIG. 1 is a schematic line drawing illustrating a cross-sectional view of several stages in an exemplary turbine in which an embodiment of the present invention may be used.

Referring now to the figures, where the various numbers represent like parts throughout the several views, FIG. 1 illustrates a cross-sectional view of several stages in an exemplary turbine 100 in which an embodiment of the present invention may be used. The turbine 100 may be a steam turbine, though the invention disclosed herein is not limited to steam turbine applications and may be used on other turbines, such as gas turbines. As shown, the several stages of the turbine 100 may include alternating stationary and rotating components. The stationary components generally are known as diaphragms 104. The rotating components are known as buckets or blades 108. A flow of working fluid is directed by the diaphragms 104 onto the blades 108, causing the blades 108 to rotate. The blades 108 maybe connected by turbine wheels 112 to a rotor 116. The rotating blades 108 thusly convert the energy of the expanding working fluid into the mechanical energy of the rotating rotor 116, which may then be coupled to an external load, such as a generator to generate power. Turbine wheel holes 120 may be defined through the turbine wheels 112. Generally, turbine wheel holes may measure approximately 0.5 to 3.0 inches in diameter and, when present, a turbine wheel may have approximately 3 to 15 wheel holes defined through its axial thickness.

A main or primary flow path, which is indicated by arrows 124, is the flow path of the working fluid that is directed through the stationary diaphragms 104 and through the rotating blades 108. A secondary flow path, which is indicated by arrows 128, also may be defined. The secondary flow path 128 generally is much smaller in volume than the main flow path 124. The secondary flow path 128 is directed in an inward radial direction to a shaft seal 132. The shaft seal 132 creates a seal that limits the amount of working fluid that travels along the route of the secondary flow path 128. As one of ordinary skill in the art will appreciate, working fluid that bypasses the main flow path 124 (and thus bypasses the blades 108) decreases the efficiency of the turbine 100 because no work is extracted from it. The working fluid that does travel through the shaft seal 132 then generally travels in an outward radial direction until reaching one of the turbine wheel holes 120. The secondary flow then passes through the turbine wheel 112 via the turbine wheel holes 120 and continues toward the next shaft seal 132. The secondary flow path 128 then similarly traverses the next stage of the turbine 100, as illustrated.

As described above, leakage through the turbine wheel holes 120 may be advantageous under certain operating conditions. For example, the turbine wheel holes $\mathbf{120}_3$may allow leakage of the secondary flow through the turbine wheel so to prevent reentry of the secondary flow back into the primary flow path, which may cause inefficient flow patterns in the primary flow. In addition, turbine wheel holes 120 may be provided to reduce the pressure drop across the turbine wheel 112, which under certain conditions, may be necessary. However, blocking, plugging or reducing turbine wheel holes 120 may become desirable, such as, for example, when an older turbine is being updated or refurbished and an increase in operating efficiency is desired.

Figure 2:
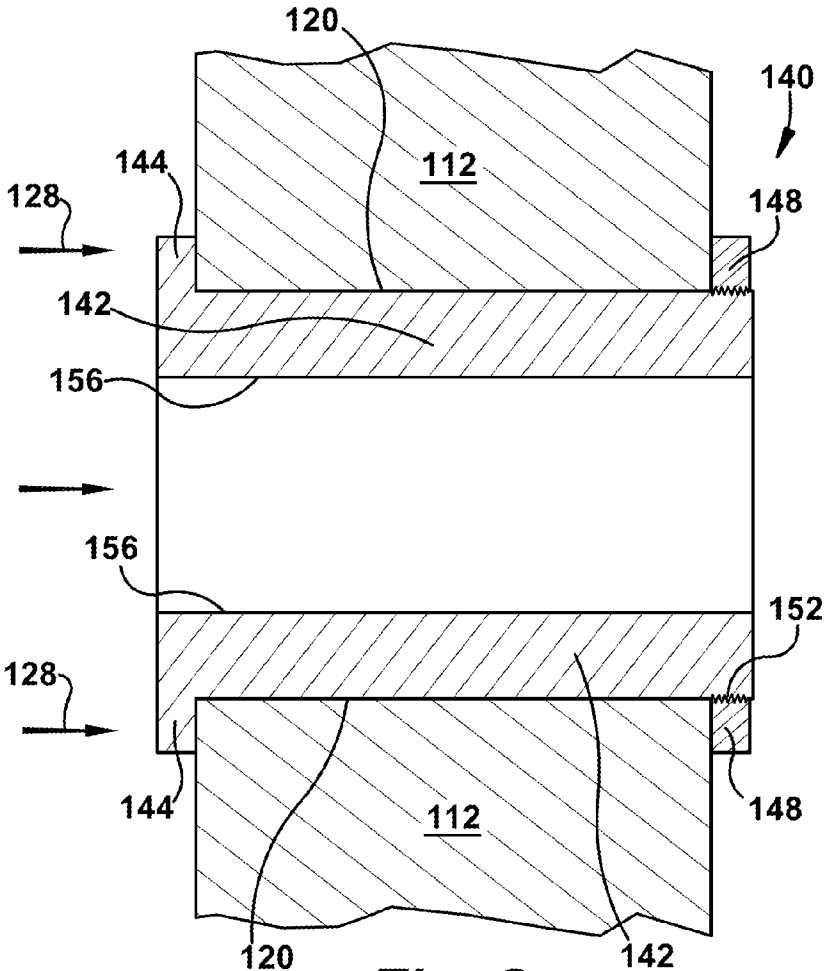
FIG. 2 is a cross-sectional view of a turbine wheel hole plug according to an exemplary embodiment of the present invention.

FIG. 2 is a cross-sectional view of a turbine wheel hole plug 140 according to an exemplary embodiment of the present invention. The turbine wheel hole plug 140 may be shaped and sized such that it corresponds to the size and shape of the turbine wheel hole 120 it is meant to plug. As used herein, "to plug" a hole shall be interpreted to mean either blocking the entirety or a portion of the hole. The turbine wheel hole plug 140 may have a body 142. In most cases, because turbine wheel holes 120 generally have a circular cross-section, the turbine wheel hole plug 140 will have a cylindrical body 142, as illustrated. Of course, if the turbine wheel hole 120 is a different shape, other shapes and configurations for the turbine wheel hole plug 140 are possible. The cylindrical body 142 of the turbine wheel hole plug 140 may be sized such that it fits relatively snuggly into the turbine wheel hole 120, i.e., the diameter of the cylindrical body 142 is only slight smaller than the diameter of the turbine wheel hole 120.

At one end of the cylindrical body 142 of the turbine wheel hole plug 140, a first flange or upstream flange 144 may be formed, as illustrated in FIG. 2. The upstream flange 144 may take many forms, but in the case of a cylindrical body 142, it may take a cylindrical shape also, as illustrated. The upstream flange 144 may have a diameter greater than the cylindrical body 142 and greater than the diameter of the turbine wheel hole 120 such that the upstream flange 144 provides a "stop" when the body 142 is fully inserted in the hole 120.

The other end of the cylindrical body 142 may be a threaded extension 152, as illustrated in FIG. 2. The length of the turbine wheel hole plug 140 may be such so that when inserted into the turbine wheel hole 120 the threaded extension 152 protrudes out of the other end of the turbine wheel hole 120, as illustrated. The turbine wheel hole plug 140 also may include a second or downstream flange 148. In some embodiments, the downstream flange 148 may be detachably fixed to the cylindrical body 142. As the embodiment of FIG. 2 illustrates, the downstream flange 148 may screw onto the threaded extension 152. That is, the downstream flange 148 may be a cylindrical ring that is threaded along an inner surface such that it may be screwed onto the threaded extension 152 of the cylindrical body 142. Of course, other attachment methods may be used.

As already described, depending on the certain conditions, it may be preferable to completely block the turbine wheel hole 120 so that substantially no flow is allowed to pass through it, or it may be preferable to partially block the turbine wheel hole 120, reducing its diameter so that a decreased amount of flow is allowed to pass through it. If it is desired that the turbine wheel hole 120 may be completely blocked, the cylindrical body 142 may be formed so that it is solid or forms a solid surface in the turbine wheel hole 120 that blocks substantially all of the secondary flow from traveling though the turbine wheel hole 120. (Note that insubstantial amounts of the secondary flow may still pass through the wheel hole 120 even when "completely blocked" via the small areas that may remain between the turbine wheel hole plug 140 and the turbine wheel hole 120.)

If, on the other hand, it is desired to reduce the amount of secondary flow moving through the turbine wheel hole 120 and not completely block it, the cylindrical body 142 may have a bore hole 156 (the diameter of which is indicated in FIG. 2 by the dashed lines). The bore hole 156 may be of any configuration that allows the desired amount of secondary flow through the turbine wheel hole 120. As shown in FIG. 2 and as used in many preferred embodiments, the bore hole 156 may be cylindrical in shape. The diameter of the bore hole 156 may be made smaller or larger depending on the amount of secondary flow that is desired to pass therethrough. Note that the first flange 144 is described as being fixed and upstream (in relation to the direction of the steam flow) of the second flange 148. This is exemplary of a preferred embodiment only. The first flange 144 and the second flange 148 may be reversed in relation to which is upstream and which is downstream, and still function effectively. Further, in some embodiments, both of the first flange 144 and the second flange 148 may be detachably fixed to the body 142. The components of the turbine wheel hole plug 140 may be made out of any suitable material that is able to withstand the environment of the turbine, such as stainless steel.

In use, the turbine wheel hole plug 140 may be installed in a turbine wheel hole 120 so that a preferred amount of working fluid is allowed through the turbine wheel hole 120. The turbine wheel hole plug 140 may be conveniently installed by inserting the body 142 through the turbine wheel hole 120 until the first flange 144 abuts the turbine wheel 112. As already described, the turbine wheel hole plug 140 preferably may be oriented such that the first flange 144 is upstream of the second flange 148. As described, this orientation may be reversed if desired. Once the body 142 is installed in the turbine wheel hole 120, the turbine wheel hole plug 140 may be fixed in place by securing the second flange 148, which, as described, may be done by screwing the second flange 148 on the treaded extension 152. The bore hole 156, if present, may be sized to a predetermined diameter such that in use a desired amount of working fluid is allowed to pass through the turbine wheel hole 120.

Figure 3:
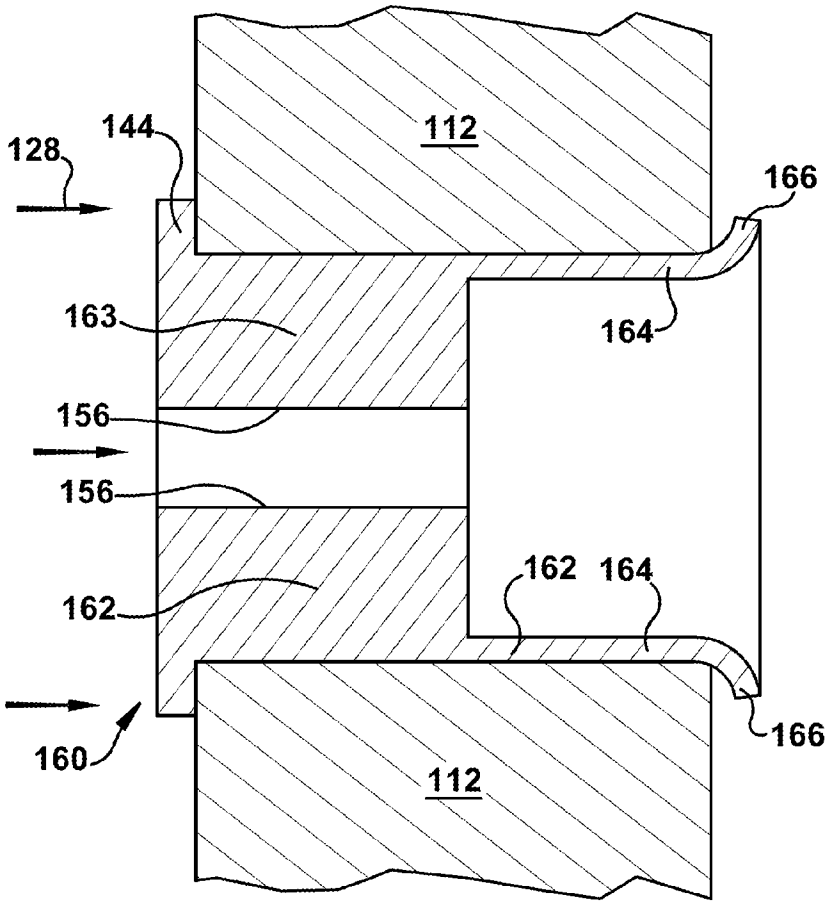
FIG. 3 is a cross-sectional view of a turbine wheel hole plug according to an alternative exemplary embodiment of the present invention.

FIG. 3 is a cross-sectional view of a turbine wheel hole plug 160 according to an alternative embodiment of the present invention. Similar to the above described turbine wheel hole plug 140, the turbine wheel hole plug 160 may be shaped and sized such that it corresponds to the size and shape of the turbine wheel hole 120 that it is meant to plug. The turbine wheel hole plug 160 may have a body 162. In most cases, because turbine wheel holes 120 generally have a circular cross-section, the turbine wheel hole plug 160 will have a cylindrical body 162, as illustrated. Of course, if the turbine wheel hole 120 is a different shape, other shapes and configurations of the turbine wheel hole plug 160 are possible. The cylindrical body 162 of the turbine wheel hole plug 160 may be sized such that it fits relatively snuggly into the turbine wheel hole 120.

In some embodiments and as shown in FIG. 3, the cylindrical body 162 of the turbine wheel hole plug 160 may have: 1) a flow determining portion 163, which will determine the amount of flow allowed through the turbine wheel hole 120 once the turbine wheel hole plug 160 is installed; and 2) a hollow portion 164, as illustrated in FIG. 3. The ratio of the flow determining portion 163 to hollow portion 164 may be approximately equal, as shown. Note that other configurations may be possible, such as a body 162 composed completely of the flow determining portion 163 or bodies 162 with differing ratios of flow determining portions 163 to hollow portions 164. As one of ordinary skill in the art will appreciate, having some portion of the body 162 be hollow may reduce material costs. Note that the option of having a portion of the body be hollow also may be used with the first embodiment described above.

Like the first embodiment described above, the first flange or upstream flange 144 may be defined at one end of the cylindrical body 162, as illustrated in FIG. 3. The upstream flange 144 may also have a cylindrical shape, though other configurations are possible. The upstream flange 144 may have a diameter greater than the cylindrical body 162 and greater than the diameter of the turbine wheel hole 120 such that the upstream flange 144 provides a "stop" when the body 142 is fully inserted in the hole 120.

At the other end of the cylindrical body 162 a flared flange 166 may be formed. As illustrated in FIG. 3, the flared flange 166 may flare in an outward direction from the turbine wheel hole 120 such that it may be conical shaped. More specifically, the flared flange 166 may be shaped like the section of a cone or bell. The diameter of the flared flange 166 at its termination point may be greater than the diameter of the turbine wheel hole 120. Thusly, the outward flare of the flared flange 166 may secure the turbine wheel hole plug 160 in place, i.e., so that the body 162 is restrained from moving axially.

As already described, depending on the certain operating conditions, it may be preferable to completely block the turbine wheel hole 120 so that no flow is allowed to pass therethrough, or it may be preferable to partially block the turbine wheel hole 120 so that the diameter of the wheel hole 120 is reduced so that a decreased amount of flow is allowed to pass therethrough. If it is desired that the turbine wheel hole 120 be completely blocked, the flow determining portion 163 of the cylindrical body 162 may be solid (i.e., have a solid face) so that it blocks substantially all of the secondary flow from traveling though the turbine wheel hole 120. (Note that insubstantial amounts of the secondary flow may still pass through the wheel hole 120 even when "completely blocked" via the small areas that may remain between the turbine wheel hole plug 140 and the turbine wheel hole 120.)

If, on the other hand, it is desired to reduce the amount of secondary flow moving through the turbine wheel hole 120 and not completely block it, the flow determining portion 163 of the body 162 may have a bore hole 156 (the diameter of which is indicated in FIG. 3 by the dashed lines). The bore hole 156 may be of any configuration that allows the desired amount of secondary flow through the turbine wheel hole 120. As shown in FIG. 3 and as used in many preferred embodiments, the bore hole 156 may be cylindrical in shape. The diameter of the bore hole 156 may be made smaller or larger depending on the amount of secondary flow that is desired to pass therethrough. Note that the first flange 144 is described as being upstream (in relation to the direction of the steam flow) of the flared flange 166. This is exemplary of a preferred embodiment only. The first flange 144 and the flared flange 148 may be reversed in relation to which is in the upstream and which is downstream and still function effectively. The components of the turbine wheel hole plug 160 may be made out of any suitable material that is able to withstand the environment of the turbine, such as stainless steel.

Figure 4:
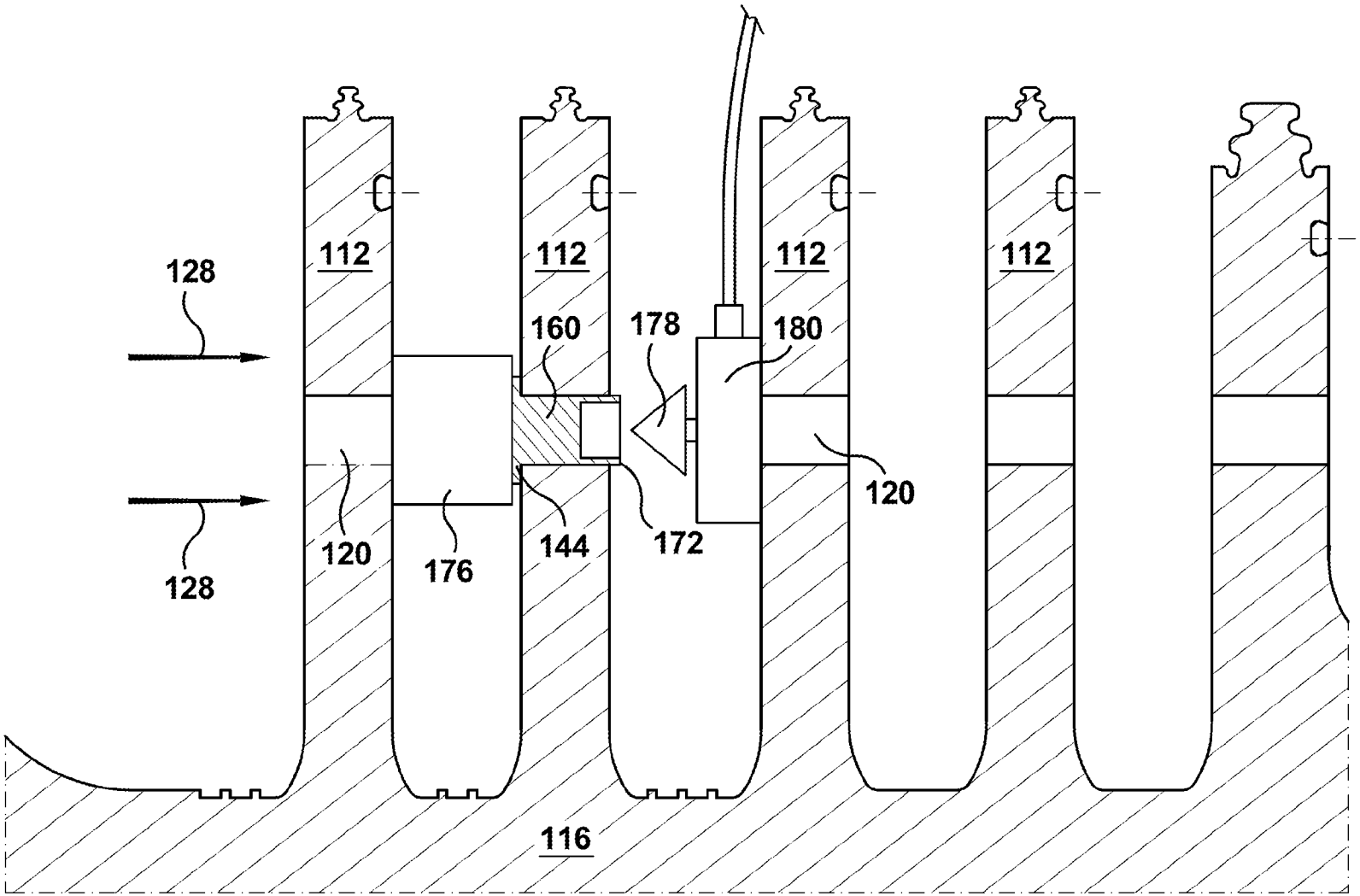
FIG. 4 is a cross-sectional view demonstrating an exemplary installment method of a turbine wheel hole plug according to an embodiment of the present invention.

In use, the turbine wheel hole plug 160 may be conveniently installed in a turbine wheel hole 120 so that a preferred amount of working fluid is allowed through the turbine wheel 120. FIG. 4 illustrates an efficient method of installing the turbine wheel hole plug 160 pursuant to an exemplary embodiment of the present invention. As illustrated, the turbine wheel hole plug 160 may be inserted into the turbine wheel hole 120. The turbine wheel hole plug 160 may be oriented such that its first flange or upstream flange 144 is in the upstream position, though, as stated, turbine wheel hole plug 160 also may function in the reverse orientation. Before installation, the flared flange 166 may be in a pre-installation unflared form 172, as illustrated in FIG. 4. In the unflared form 172, the flared flange 166 may not be flared outward, i.e., in the unflared form 172, the flared flange 166 forms a cylinder that is in line with the cylinder defined by the body 162. In the unflared form, the turbine wheel hole plug 162 may be inserted through the turbine wheel hole 120 so that the turbine wheel hole plug 160 may be positioned properly. In the proper position, the turbine wheel hole plug 160 is pushed into the turbine wheel hole 120 until the first or upstream flange 144 abuts the turbine wheel 112.

Once this is complete, a wedge block 176 may be placed into the position shown in FIG. 4. That is, the wedge block 176 is positioned so that it holds the turbine wheel hole plug 160 in a fixed installed position i.e., so that the first or upstream flange 144 remains abutted against the turbine wheel 112. The wedge block 176 may do this by being wedged between the first or upstream flange 144 and the turbine wheel 112 of a neighboring turbine stage. The wedge block 176 may be a block or other object (such as an adjustable threaded spacer) that is able to rigidly hold the turbine wheel hole plug 160 in place.

Once the turbine wheel hole plug 160 is secured in place by the wedge block 176, the flared flange 166 may be created by deforming the unflared form 172. This may be accomplished by forcing a cone 178 into the unflared form 172. As the cone 178 is pushed against the unflared form 172 it forces the unflared form 172 to flare outward. Thusly, the flared flange 166 is created. The turbine wheel hole plug 160 becomes axially locked into position by the upstream flange 144 and the flared flange 166. As shown, the cone 178 may be pushed into the unflared form 172 using a hydraulic jack 180. Other methods also may be used. While the hydraulic jack 180 is used to push the cone 178 into the unflared form 172, the hydraulic jack 180 may be secured into position by placing it against a neighboring turbine wheel 112, as illustrated in FIG. 4.

Depending on whether it is desired that all of the flow be blocked or just a partial amount of the flow, the bore hole 156 may or may not be present in the turbine wheel hole plug 160. If it is present, the bore hole 156 may be sized to a predetermined diameter such that, in use, a desired amount of working fluid is allowed to pass through the turbine wheel hole 120.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A method for plugging a turbine wheel hole in a turbine wheel, the method comprising the steps of:

obtaining a turbine wheel hole plug that includes an approximate cylindrical body, a first flange at a first end of the body, and a hollow cylinder at the second end of the body, wherein the body, the first flange and the hollow cylinder are sized such that: 1) the cylindrical body fits snuggly into the turbine wheel hole; 2) the first flange comprises a diameter that is greater than the diameter of the turbine wheel hole; and 3) the hollow cylinder protrudes from one end of the turbine wheel hole when the turbine wheel hole plug is inserted into the other end of the turbine wheel hole until the first flange abuts the turbine wheel;

positioning the turbine wheel hole plug into the turbine wheel hole; and deforming the hollow cylinder so that the hollow cylinder flares outward.

2. The method of claim 1, where the positioning the turbine wheel hole plug into the turbine wheel hole includes inserting the body of the turbine wheel hole plug into the turbine wheel hole until the first flange abuts the turbine wheel.

3. The method of claim 2, further comprising the step of using means for securing the axial position of the first flange so that the first flange is secured against the turbine wheel hole.

4. The method of claim 3, wherein the means for securing the axial position of the first flange comprises a wedge block.

5. The method of claim 4, wherein the means for securing the axial position of the first flange comprises wedging the wedge block between the first flange and a neighboring turbine wheel.

6. The method of claim 1, wherein the deforming the hollow cylinder so that the hollow cylinder flares outward includes means for pushing a cone into the hollow cylinder.

7. The method of claim 6, wherein the means for pushing comprises a hydraulic jack.

8. The method of claim 6, wherein the means for pushing is secured against a neighboring turbine wheel when the hollow cylinder is deformed.

9. The method of claim 1, wherein the first flange comprises an upstream position.

10. The method of claim 1, wherein the first flange and the hollow cylinder are integral to the body.

11. The method of claim 1, wherein the body is sized so that the body substantially blocks the entirety of the turbine wheel hole so that substantially no flow of working fluid is allowed through the turbine wheel hole.

12. The method of claim 1, wherein the body includes a bore hole, the bore hole comprising a hole through the body that, during operation, allows an amount of working fluid to flow through the turbine wheel hole.

13. The method of claim 12, wherein the bore hole comprises a cylindrical shape; and wherein the bore hole comprises a predetermined diameter that allows a preferred amount of working fluid to flow through the turbine wheel hole.

14. The method of claim 1, wherein:

the body comprises both a flow determining portion and a hollow portion; and the flow determining portion determines the amount of flow allowed through the turbine wheel hole by including one of a solid body that blocks substantially the entire turbine wheel hole and a bore hole that is sized such that, during operation, a preferred amount of working fluid is allowed to flow through the turbine wheel hole.

15. A method for plugging a turbine wheel hole in a turbine wheel, the method comprising the steps of:

obtaining a turbine wheel hole plug that includes an approximate cylindrical body, a first flange at a first end of the body, and a hollow cylinder at the second end of the body, wherein the body, the first flange and the hollow cylinder are sized such that: 1) the cylindrical body fits snuggly into the turbine wheel hole; 2) the first flange comprises a diameter that is greater than the diameter of the turbine wheel hole; and 3) the hollow cylinder protrudes from one end of the turbine wheel hole when the turbine wheel hole plug is inserted into the other end of the turbine wheel hole until the first flange abuts the turbine wheel;

positioning the turbine wheel hole plug into the turbine wheel hole such that the first flange abuts the turbine wheel;

using means for securing the axial position of the first flange so that the first flange is secured against the turbine wheel hole; and pushing a cone into the hollow cylinder so that the hollow cylinder spreads outward.

16. The method of claim 15, wherein the means for securing the axial position of the first flange comprises wedging a wedge block between the first flange and a neighboring turbine wheel.

17. The method of claim 15, wherein a hydraulic jack pushes the cone into the hollow cylinder.

18. The method of claim 17, wherein the hydraulic jack is secured against a neighboring turbine wheel when the cone is pushed into the hollow cylinder so that the hollow cylinder spreads outward.

19. The method of claim 15, wherein the first flange and the hollow cylinder are integral to the body.

20. The method of claim 15, wherein the body includes a bore hole, the bore hole comprising a hole through the body that, during operation, allows a preferred amount of working fluid to flow through the turbine wheel hole.

* * * * *